US006854676B2

(12) United States Patent
Dubech et al.

(10) Patent No.: US 6,854,676 B2
(45) Date of Patent: Feb. 15, 2005

(54) WASTE SHREDDER, COMPONENT PARTS AND MAINTENANCE METHOD

(75) Inventors: Gérard Dubech, Toulouse (FR); Christian Madaule, Jonquieres (FR)

(73) Assignee: Precimeca, Blagnac (FR)

( * ) Notice: Subject to any disclaimer, the term of this patent is extended or adjusted under 35 U.S.C. 154(b) by 96 days.

(21) Appl. No.: 10/276,885

(22) PCT Filed: May 14, 2001

(86) PCT No.: PCT/FR01/01449

§ 371 (c)(1),
(2), (4) Date: Nov. 15, 2002

(87) PCT Pub. No.: WO01/89700

PCT Pub. Date: Nov. 29, 2001

(65) Prior Publication Data

US 2003/0122006 A1 Jul. 3, 2003

(30) Foreign Application Priority Data

May 25, 2000 (FR) ..... 00 06701

(51) Int. Cl.[7] ..... B02C 4/08
(52) U.S. Cl. ..... 241/236; 241/294
(58) Field of Search ..... 241/236, 243, 241/292.1, 294, 295, 298

(56) References Cited

U.S. PATENT DOCUMENTS 3,314,617 A * 4/1967 Sargood ..... 241/261.3
4,854,508 A 8/1989 Dicky
4,901,929 A 2/1990 Barclay
5,730,375 A 3/1998 Cranfill et al.

FOREIGN PATENT DOCUMENTS

JP 08323233 12/1996

* cited by examiner

*Primary Examiner*—Lowell A. Larson
(74) *Attorney, Agent, or Firm*—Young & Thompson

(57) ABSTRACT

A waste grinder and a method for maintenance of the grinder. The grinder comprises at least one rotor which has at least one shearing wheel comprising: a ring-support, which is designed to be rotated by a shaft and defines a plurality of peripheral sections, a plurality of shearing blades which are disposed corresponding to the sections such as to project radially relative to the peripheral surface of the ring-support, the wheel comprises a plurality of blade-holder parts, onto which the blades are secured by detachable securing elements which are accessible from the outer lateral shearing surfaces of the blades, the blade-holder parts being designed to be applied and secured by detachable elements for securing onto the sections of the peripheral surface of the ring-support.

18 Claims, 6 Drawing Sheets

WASTE SHREDDER, COMPONENT PARTS AND MAINTENANCE METHOD

The invention relates to a waste grinder such as a vehicle tyre bi-rotor grinder for example. It also relates to a grinder rotor, as well as to the shearing wheel(s) which equip(s) the said rotor. It extends to a method for maintenance of the waste grinders, comprising a method for restoration of the plates-blades which assure the shearing of the said waste, a method for dismantling the said plates-blades in order to restore them, and if applicable, a method for dismantling a rotor of the grinder.

The known grinders comprise at least one rotor which consists of a plurality of shearing wheels, a shaft onto which the said wheels are secured in order to rotate them, and a plurality of braces which separate each two adjacent wheels. Each wheel comprises a ring-support which is secured to the shaft, and is designed to support the units which assure the shearing of the waste, the said units forming teeth for driving and shearing the waste on the periphery of the wheels. These units, which are subjected to substantial friction, wear quickly, despite use of particularly strong alloys in their production. The shearing wheels are of three types.

According to a first known type, which is proposed by patent U.S. Pat. No. 4,854,508, each shearing wheel comprises a plurality of plates-blades with an axial dimension which is substantially equal to that of the ring-support, which are secured to the peripheral surface of the latter by means for securing which are accessible from the peripheral surfaces of the said plates-blades.

This type of wheel has the following disadvantage: the worn plates-blades, the cutting power of which has become insufficient, cannot be reused after being re-sharpened. In fact, although a reduction in the radial dimension of a plate-blade can be made up after it has been sharpened by adding a wedge between the ring-support and the plate-blade, a reduction in its axial dimension cannot be compensated for by a similar system. However, in the most common case of bi-rotor grinders, the waste is cut not only by the overlapping of the wheels of the two rotors of the grinder (which overlapping depends on the radial dimension of the wheels and thus on that of the plates-blades), but also and above all by minimisation of the functional shearing play which exists between two adjacent wheels (which play depends on the axial dimensions of the plates-blades). Frequent changing of the plates-blades and the impossibility of restoring and reusing the worn plates-blades adds considerably to the cost of maintenance of these grinders.

According to a second type of known device, proposed by patent U.S. Pat. No. 4,901,929, the lateral cheeks of the rings-supports each have a shoulder on which the blades are supported, which extends radially beyond the peripheral surface of the ring-support. Each blade is secured rigidly to a lateral cheek of the ring-support by means for securing which are accessible laterally from holes provided in the blade situated opposite, on the other lateral cheek of the ring-support. Contrary to the first type of device described, the shearing units of this second type, i.e. the blades, can be separated from the wheel, restored (sharpened), then reused, subject to compensation, by wedges which are interposed between the lateral cheeks of the ring-support and the blades, for the decrease caused by sharpening of the axial dimension of the blades. However, on the other hand, this device has the following disadvantage: the means for lateral securing of the said blade on the ring-support are inaccessible, at least using conventional tools, owing to their arrangement and their lateral position on the wheel (when the wheel is fitted on its rotor it is edged by two adjacent wheels which limit the space which is free laterally). Removal of a blade in order to restore it sometimes even requires complete dismantling of the rotor and its wheels. This operation consequently gives rise to lengthy and costly immobilisation of the grinder.

According to a third type of known device, each wheel comprises a relatively wide ring-support which has two radial extensions for securing a blade, which are separated by a median space and each support a blade on their outer lateral surface. The blades are secured to these extensions by means for securing which are accessible from the aforementioned median space, from inner lateral surfaces of the said extensions. Contrary to the first type of device described, the worn blades can be reused after they have been re-sharpened, provided that a wedge is used to make up the thickness as explained for the second device. However the removal of a blade in order to restore it continues to be a difficult operation for the same reasons as for the preceding device (limited accessibility to the securing devices of the blades). This operation consequently gives rise to prolonged and costly immobilisation of the grinder.

In addition, it should be noted that in the case of the last two types of devices described, restoring the worn blades requires highly constraining machining tolerances and accuracy. In fact, the surfaces of the blade concerned and of the making-up wedge, are ground before assembly of the said blade and the said wedge onto the ring-support. The functional shearing play obtained (play which exists between a blade of a wheel of a rotor and the adjacent blade of the adjacent wheel situated on the other rotor) thus depends on the machining tolerance of the wedge, the grinding tolerance of the lateral surfaces of the blade, and the fitting tolerance of the wedge and the blade on the ring-support. All these operations must therefore be carried out with particular care in order to be able to obtain the required functional shearing play. The constraints which are associated with maintenance of the known grinders (immobilisation of the grinder and stringent tolerances) increase considerably the duration and cost of the maintenance operations.

In these different embodiments, the object of the present invention is to eliminate the disadvantages previously described and to provide a new solution to each of the following objectives:

- to obtain accurately and with certainty, simply and quickly, the functional shearing play required during restoration of a worn blade;
- to simplify the operations of maintenance of the blades, in particular by making the means for securing the blades easily accessible and manoeuvrable, and by decreasing the number of steps necessary in order to dismantle a blade;
- to reduce the time of immobilisation of a grinder caused by an operation of restoring a blade, in order to decrease the maintenance costs;
- to decrease the costs of machining the blades and wedges used to make up the thickness, by permitting less stringent machining tolerances; and
- to make possible dismantling of a single rotor, in a few operations.

Another objective of the invention is to propose rotors which are compatible with use of a rake which is designed to remove the waste which accumulates between the wheels of the said rotor, which waste exerts a substantial resistant force on the wheels in rotation and consequently gives rise to excess consumption of energy.

Another objective of the invention is to reduce the power consumed by these grinders, and thus to obtain substantial energy savings.

For this purpose, the invention proposes a shearing wheel for a waste grinder, comprising:

a cylindrical ring-support, which has two lateral cheeks and a peripheral surface which define a plurality of sections, the said ring-support being designed to be rotated around an axis by a shaft (the ring-support can have a central hollow core in order to allow it to be fitted onto the said shaft, or to form a single part together with the latter); and a plurality of shearing blades, each of which has an outer lateral shearing surface, each blade being disposed corresponding to a section of the peripheral surface of the ring-support, such as to project radially relative to the said peripheral surface.

According to the present invention, the said shearing wheel is characterised in that it comprises:

a plurality of blade-holder parts, each comprising a surface, known as the inner surface, with a shape which is designed to be applied to a section of the peripheral surface of the ring-support, a surface, known as the outer surface, which is opposite the inner surface, and at least one lateral surface for securing a shearing blade;

detachable means for securing, which are designed to permit securing of a shearing blade onto a blade-holder part, and are accessible from the outer lateral shearing surface of the blade, the said blade being designed to be secured onto the blade-holder part opposite a lateral securing surface of the said part, in order to form a rigid blade-holder/blade assembly together with the blade-holder part; and detachable means for securing, which are designed to permit securing of a blade-holder part onto the ring-support, and are accessible from the outer surface of the said blade-holder part, in order to allow the blade-holder/blade assembly to be secured onto the ring-support, or removed from the latter.

Thus, in the device according to the invention, the removal of a blade requires only two steps, i.e.: separation of the blade-holder/blade assembly from the ring-support, then separation of the blade from the blade-holder part. The first step is carried out without difficulty from the periphery of the wheel by manoeuvring the corresponding means for securing, which are accessible directly, without using special tooling. The second step is carried out without difficulty once the blade-holder/blade assembly has been separated from the wheel.

Advantageously and according to the invention, each blade is secured to a blade-holder part, such that it extends radially at least as far as the outer surface of the said blade-holder part. In a preferred version of the invention, each blade has a form and an arrangement which are designed to project radially relative to the outer surface of the blade-holder part, at a height which increases from upstream in the downstream direction (relative to the direction of rotation of the wheel), such as to form a tooth to drive and shear the waste. The outer lateral ridges of the blades, which are sharpened such as to cut perfectly, thus assure optimised cutting of the waste, and the outer lateral surfaces of the said blades complete the reduction of the waste by shearing. It should be noted that the peripheral teeth formed by the blades make it possible both to perforate the waste and cut it, and to drive the said waste into the grinder.

Advantageously and according to the invention, each blade has an edge, known as the inner edge, which is designed to be placed in the axial extension of the inner surface of the blade-holder part onto which it is secured, in order to avoid any accumulation of waste between the said ring-support and the said blade.

Advantageously and according to the invention, each blade has an inner edge with a form which is designed to be supported at least partly on a section of the peripheral surface of the ring-support, each blade-holder part having an axial dimension which is smaller than the axial dimension of the ring-support.

According to another embodiment of the invention, each blade-holder part has a base and a head with an axial dimension which is smaller than that of the base, such that:

the head has at least one lateral surface for securing a blade, opposite which a blade is secured; and the base has an inner surface which is designed to be applied to a section of the peripheral surface of the ring-support and at least one outer surface which is opposite the inner surface against which the blade is supported.

Advantageously and according to the invention, each section of the ring-support supports a blade-holder part, and each blade-holder part supports at least one blade, the blades being arranged around the ring-support such that two adjacent blades are contiguous, the outer lateral shearing surfaces of the blades forming a continuous lateral shearing surface. In an advantageous embodiment, each blade-holder part has two lateral surfaces for securing a blade, onto each of which a blade is secured such as to form two opposite continuous lateral shearing surfaces on the periphery of the wheel. When the wheel is fitted onto the shaft of a rotor of a bi-rotor grinder, during rotation these lateral shearing surfaces intersect with functional shearing play, with the lateral shearing surfaces of the wheels of the other rotor. The cutting power of the blades (sharpened ridges) and the minimisation of the functional shearing play make it possible to grind extremely strong waste such as vehicle tyres (and in particular heavy-goods vehicle tyres), and to provide excellent efficiency of the grinder, combined with moderate energy consumption. The lateral shearing surfaces are preferably continuous in order to avoid any accumulations of waste between two contiguous blades.

According to one embodiment, the ring-support has a peripheral surface with a cylindrical shape which revolves around the axis of rotation, the blade-holder parts having inner surfaces with a cylindrical shape which is designed to be applied to a section of the said peripheral surface of the ring-support.

According to an advantageous variant, the ring-support has a polygonal peripheral surface which defines flat sections, each blade-holder part having a flat inner surface which is designed to be applied to a section of the peripheral surface of the said ring-support.

The invention also relates to a rotor for a waste grinder, comprising at least one shearing wheel as previously defined, which is integral with a shaft which rotates the said wheel around an axis. In a preferred version of the invention, the rotor comprises a plurality of identical wheels which are spaced regularly along the drive shaft by braces, each blade-holder part of each of the said wheels having two lateral securing surfaces onto each of which a blade is secured, such as to form around the said wheel two continuous opposite lateral shearing surfaces. In general, the rotor also comprises two end wheels which have only one continuous lateral shearing surface, the blade-holder parts of the said end wheels supporting only a single blade which faces "the interior" of the rotor.

The invention also relates to a waste grinder comprising at least two rotors such as previously defined with parallel axes, the adjacent wheels of the said rotors being arranged on their respective shaft such as to interpenetrate and to have adjacent lateral shearing surfaces which are separated by functional shearing play. The axes of the two rotors are separated by a distance which is smaller than the sum of the radius of a wheel of the first rotor and of the radius of a wheel of the second rotor, such that the wheels intersect. The said wheels are spaced along their respective shaft such that part of the lateral shearing surface of a wheel of a rotor passes, with functional shearing play, continually opposite part of the lateral shearing surface of the adjacent wheel which is situated on the other rotor.

The invention extends to a method for maintenance of a waste grinder such as previously described, for the purpose of replacement or restoration of at least one blade, wherein:

the blade-holder/blade assembly concerned is separated from the ring-support, by manoeuvring the means for securing which connect the blade-holder part to the ring-support; and a new blade-holder/blade assembly is put into place and secured to the peripheral surface of the ring-support, by manoeuvring the means for securing which connect the blade-holder part to the ring-support.

The new blade-holder/blade assembly which is secured to the ring-support is advantageously a spare assembly, which is ready to be used to replace the blade-holder/blade assembly comprising the worn blade. In this case replacement of the worn assembly is a very short operation, which reduces considerably the time of immobilisation of the grinder, and therefore the maintenance costs.

It is also possible to reuse the worn blade-holder/blade assembly immediately by replacing the blade concerned by a new blade according to the following method: the said assembly having been detached and separated from the wheel, the blade is separated from the blade-holder part by manoeuvring the means for securing which connect the blade to the said part, the said blade is replaced by a new blade with suitable dimensions, and the latter is secured to the blade-holder part by manoeuvring the means for securing which connect the blade to the said part, and the new blade-holder/blade assembly obtained is put into place and secured to the ring-support.

The worn blade can be reused after grinding (sharpening) of its cutting and shearing surfaces, either immediately on the same blade-holder/blade assembly, or subsequently during another operation of restoration of one or a plurality of blades. For this purpose, the worn blade having been separated from the blade-holder part, the said blade is refitted onto the blade-holder part (or onto another blade-holder part in the case of further use), by manoeuvring the means for securing which connect the blade to the said part, after having interposed a squared part, known as a wedge for making up the thickness, between the said blade and the said blade-holder part (against the outer lateral surface of the latter) such that the blade-holder/wedge/blade assembly has an axial dimension which is slightly greater than that required; the outer lateral surface of the blade is ground such that the axial dimension of the blade-holder/blade assembly corresponds to the appropriate dimension and the outer lateral shearing surface of the restored blade is at the required distance from the blade-holder part, and the assembly obtained is put into place and secured on the peripheral surface of the ring-support. The said assembly can also be stored for further use, during another maintenance operation. In this case, a blade-holder/blade assembly which is new or has previously been restored according to the invention is put into place and secured on the peripheral surface of the ring-support as a replacement for the worn blade-holder/blade assembly removed, and the worn blade-holder/blade assembly is restored as previously described and stored whilst waiting to be reused.

It should be noted that in general the two opposite blades of a blade-holder/blade part are ground during a single maintenance operation. A wedge to make up the thickness is inserted between the blade-holder part and each of the blades. The outer lateral shearing surfaces of the two blades are ground one after the other as previously explained.

In the device according to the invention, the grinding of the shearing surfaces and of the cutting surfaces or ridges is an easy operation, and the re-sharpening or machining tolerances are less stringent than those encountered for the known grinders. In fact, the functional shearing play depends on the total axial dimension of the blade-holder/blade assembly and on the relative axial position of the latter on the ring-support. In the invention, the grinding of the outer shearing surface of a blade is advantageously carried out once the blade and its wedge have been fitted onto the blade-holder part. The assembly obtained can be secured to tooling which is then positioned on a grinding machine; this tooling reproduces the axial dimension of the ring-support and is designed such that the assembly is disposed according to its position on the ring-support; the lateral surfaces of this tooling thus act as reference planes for carrying out the grinding of the blades. The two opposite blades of the blade-holder/blade assembly are preferably ground during a single maintenance operation, such that the total axial dimension of the assembly is that which is appropriate. By means of the invention, the functional shearing play depends only on two tolerances, i.e. the grinding tolerance of the outer lateral surface of the blades, which is an operation carried out in the factory with considerable precision, and the fitting tolerance of the blade-holder/blade assembly on the ring-support. Contrary to the known grinders, it is not necessary to machine the making-up wedge with precision, since the machining tolerances of the said wedge, of the inner lateral surface of the blade and even of the outer lateral securing surface of the blade-holder part, do not affect the final position of the outer shearing surface of the blade (except in the case of replacement of the worn blade by a new blade which is not required to undergo grinding of its outer lateral surface).

In general, all the blades of a shearing wheel will preferably be restored during a single maintenance operation, in order not to create discontinuity in the lateral shearing surface of the wheel. In this case, all the blade-holder/blade assemblies are detached from the ring-support, and the two opposite blades of each blade-holder part are removed in order to permit addition of a wedge between each of them and the blade-holder part. The reconstituted blade-holder/wedge/blade assemblies are then secured by the securing means which habitually connect the blade-holder parts to the ring-support, onto tooling which is designed to be fitted onto a grinding machine, the plane which contains the said securing units (or optionally the outer lateral surfaces of the said tooling) acting as a reference plane for the grinding. The outer lateral shearing surfaces of the blades which are situated on a single side of the tooling are ground simultaneously. When the two series of lateral shearing surfaces (on both sides of the tooling) are ground, the assemblies thus restored are removed from the tooling and refitted onto the ring-support of the shearing wheel.

Finally, it should be noted that it is also possible and advantageous to grind the outer peripheral edges of the blades according to a method which is similar to that previously described, in order to sharpen the outer lateral shearing ridges.

The invention also relates to a method for dismantling a rotor of a waste grinder according to the invention, wherein:

- at least one row of axially aligned blade-holder/blade assemblies is removed by manoeuvring the means for securing which connect each blade-holder part concerned to its ring-support;
- the rotor is rotated around its axis, such that the row of sections of peripheral surfaces without blade-holder/blade assemblies is situated on the plane which contains the axes of rotation of the two rotors; and
- the rotor is slid axially until it is withdrawn from the grinder.

This method is particularly advantageous for grinders in which the rotors are driven by two gear motors, each of which is situated on any of the axial ends of the said rotors, or by a reduction gear which has two outputs or a transfer box which is connected to one or more reduction gears, the said outputs or reduction gears being situated on the same side of the grinder and each being connected to an axial end of the rotors.

The invention also relates to a waste grinder, some of its component parts, and a method for maintenance of the said grinder, characterised in combination by some or all of the characteristics described previously and hereinafter.

Other objects, characteristics and advantages of the invention will become apparent from reading the following description provided with reference to the figures of the attached drawings, which illustrate embodiments of the invention by way of non-limiting example. In these drawings.

Figure 1:
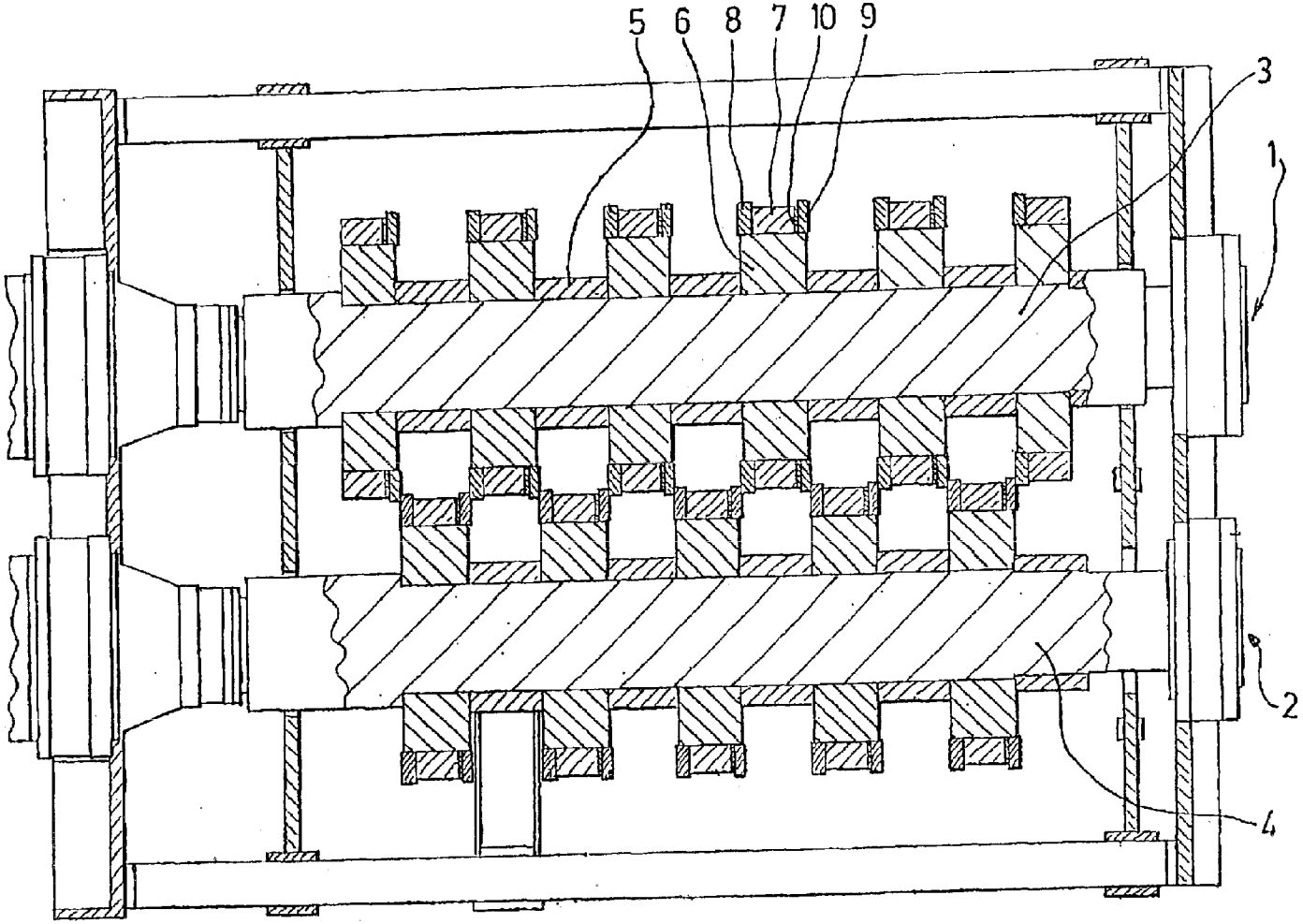
FIG. 1 is a front view of an embodiment of a bi-rotor waste grinder according to the invention, most of the units being intersected by a vertical plane which passes through the axes of the two rotors.

The waste grinder shown by way of example in FIG. 1 comprises two rotors 1 and 2 with parallel axes, each of which consists mainly of a shaft, 3 and 4 respectively, which is rotated by a motor (not shown), and a plurality of wheels which are identical to one another, with the exception of the two wheels which are situated at the ends of the rotors. The said wheels are fitted rigidly and secured to the shafts, 3 and 4 respectively, and are spaced by braces 5.

Each wheel comprises a ring-support 6, a plurality of blade-holder parts 7 which are distributed around its periphery and each support two opposite blades 8 and 9 (a single blade in the case of an "end" wheel) which project radially from the said blade-holder part 7, and optionally one (or two) wedge(s) 10 to make up the thickness. The axes of rotation of the rotors 1 and 2 are separated by a distance which is smaller than the sum of the radius of a wheel of the first rotor and of the radius of a wheel of the second rotor, such that the wheels of the two rotating rotors interpenetrate. The wheels of a rotor are spaced along their shaft by a distance which is equal, to within the play, to the axial dimension of the blade-holder/blade assembly of the wheels of the other rotor, plus the functional shearing play, such that the intersection of the wheels of the two rotors during their rotation gives rise to shearing of the waste.

Figure 2:
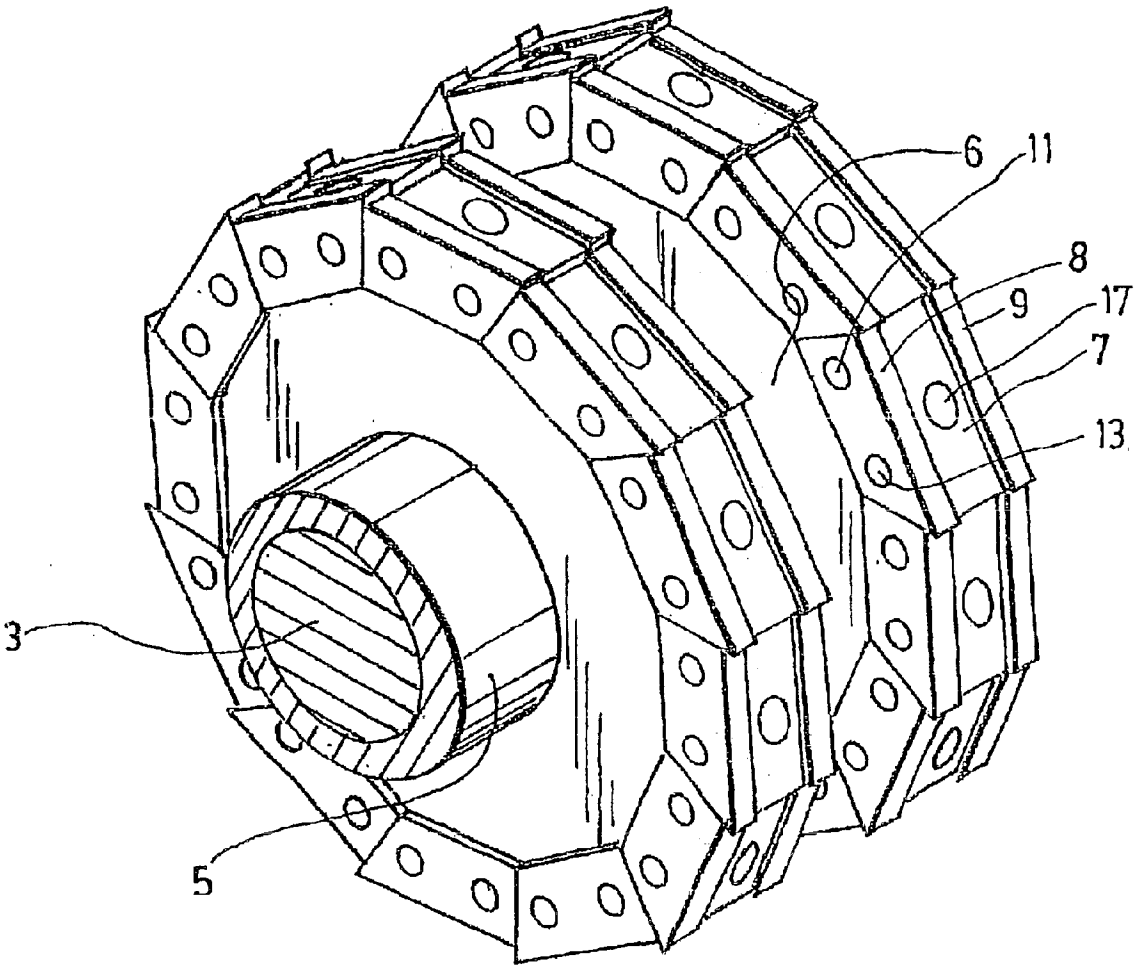
FIG. 2 is a partial perspective view of an embodiment of a rotor according to the invention.
Figure 3:
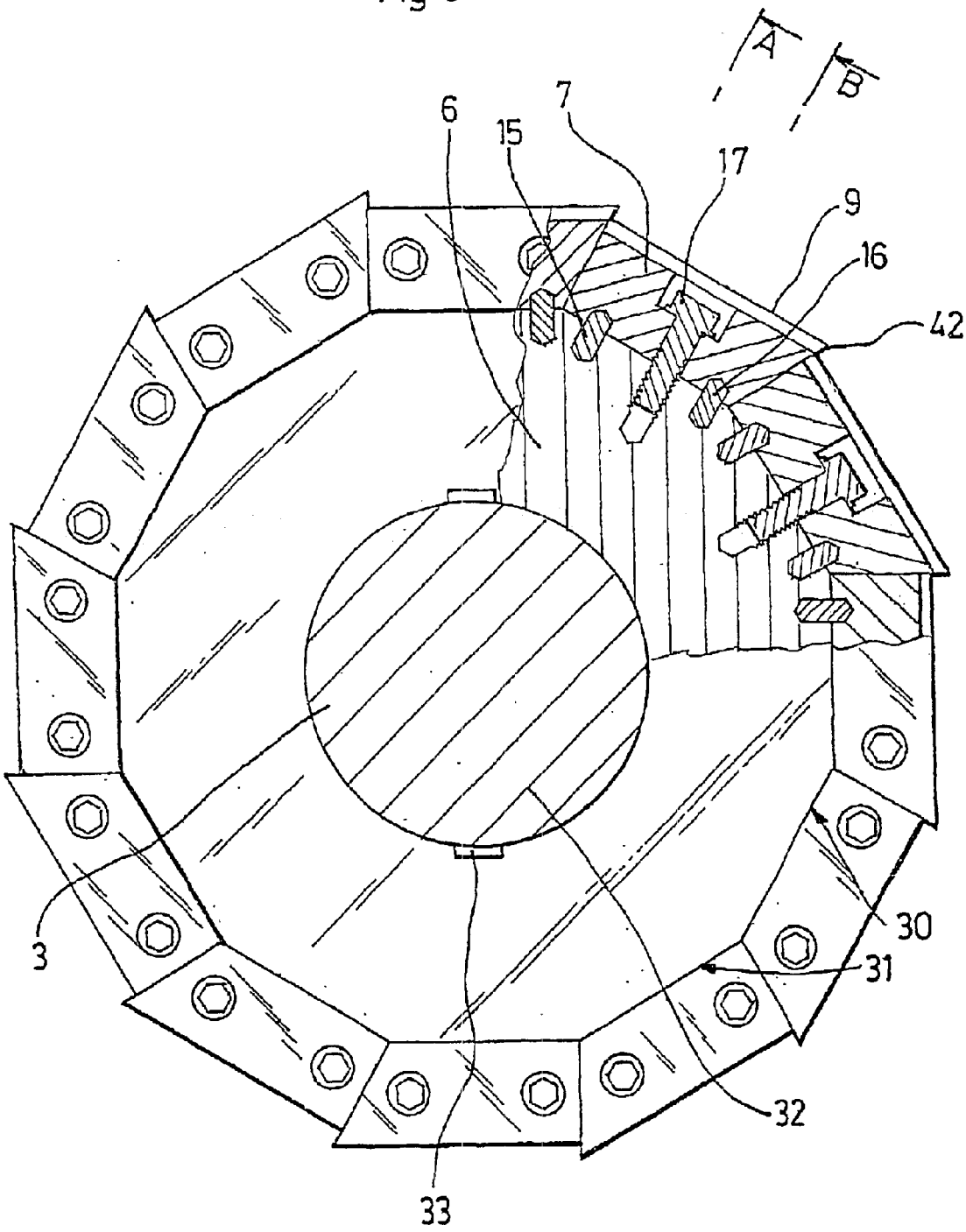
FIG. 3 is a lateral view which is partially cut out according to a plane perpendicular to the axis of rotation.

FIGS. 2 and 3 represent respectively two shearing wheels of a single rotor, separated by a brace, and one of the said wheels. The ring-support 6 of the wheel is secured to the drive shaft 3 by keys 33. It has an outer peripheral surface 29 which is polygonal in the example, which defines flat sections 30, 31, . . . , to receive the blade-holder 7/blade 8,9 assemblies.

Figure 5:
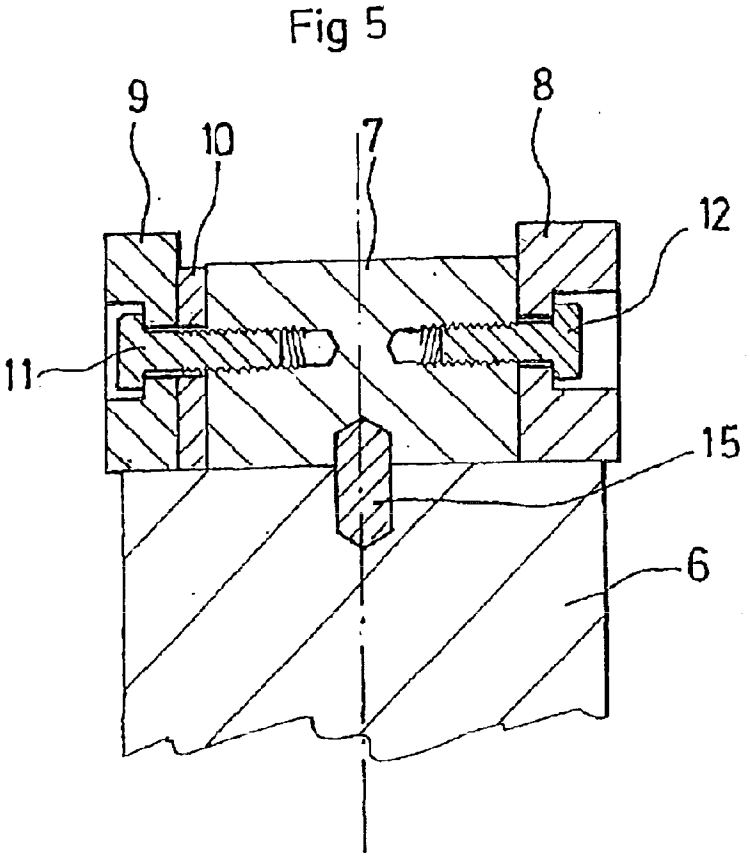
FIG. 5 is a detailed cross-section through a plane A which is offset relative to the previous plane.
Figure 4:
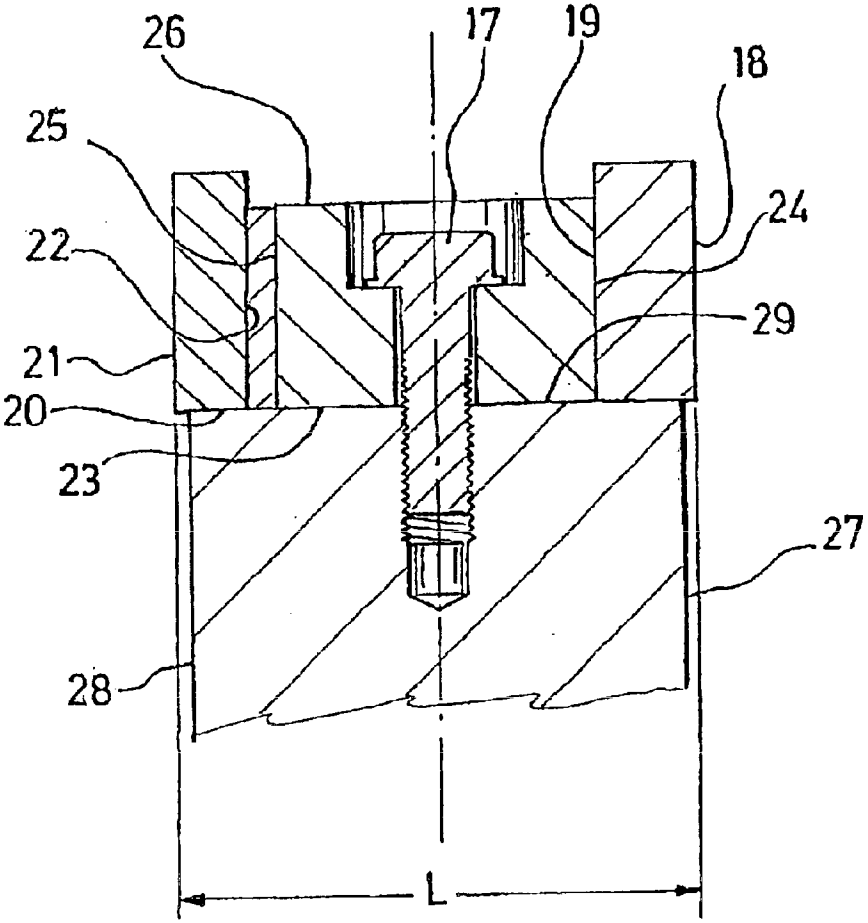
FIG. 4 is a detailed cross-section through a plane B which is parallel to the axis of rotation of the wheel, and passes through the latter.

Each blade-holder part 7 is positioned on a section 30 of the ring-support 6 by two centring pins 15 and 16, and is secured to the said section 30 by a central screw 17 which is accessible from the outer surface 26 of the blade-holder part 7, as shown in FIG. 4. Each blade 8 (or 9) is partly supported on a section of the peripheral surface 29 of the ring-support 6, as shown in FIGS. 4 and 5, and is secured to a blade-holder part 7 by two screws 11 and 13 (or 12 and 14) which are accessible laterally, and are schematised in FIGS. 5, 6 and 7. It should be noted that only two bores and two securing screws are necessary and sufficient to position and secure each blade onto a blade-holder part, contrary to the device described by U.S. Pat. No. 4,901,929, each blade of which has no less than 8 bores and 4 securing screws. This decreases considerably the production cost of the blades.

Figure 9:
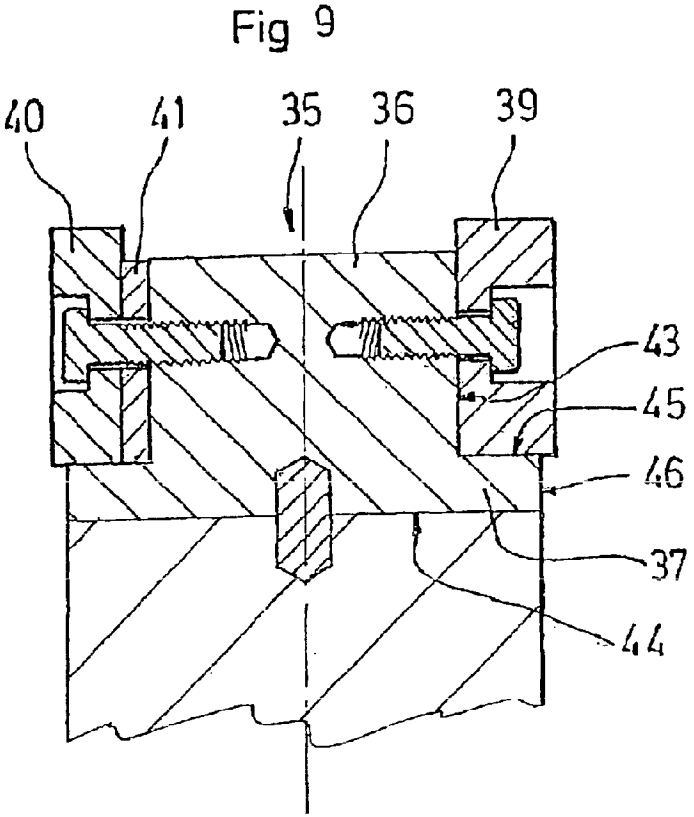
FIGS. 8 and 9 are partial cross-sections of another embodiment through planes which are parallel to the axis of rotation of the wheel, similar to the aforementioned planes A and B.

The required axial dimension L of the detachable blade-holder/blade assembly 34 is optionally obtained by adding one (or two) wedge(s) 10 to make up the thickness. The left-hand part of FIG. 4 (or FIGS. 5, 8 or 9) represents a blade 9 (or 40) which has been subjected to grinding of its outer lateral shearing surface (presence of a wedge 10 or 41 to make up the thickness). The right-hand part illustrates the case of a new blade (no wedge). A blade-holder/blade assembly according to the invention could be represented by the left-hand half of FIG. 4 (or of FIG. 8) and its symmetrical equivalent (case of an assembly comprising two wedges and two ground blades), or by the right-hand half of the said figure and its symmetrical equivalent (case of an assembly comprising two new blades and no wedge).

It should be noted that the axial dimension of a blade-holder/blade assembly can be greater than that of the ring-support, such that the blades are not supported on the peripheral surface of the said ring-support. In this case, if the blades extend radially towards the shaft, opposite the lateral cheeks of the ring-support, the axial dimension of the blade-holder/wedge assembly is preferably equal to that of the ring-support, in order for the inner lateral surfaces of the blades to abut the lateral cheeks of the ring-support, thus preventing the accumulation of waste between the said surfaces and the said cheeks.

The parts which are involved in shearing and cutting the waste, or the parts which are particularly exposed to the friction of the waste, i.e. the blades 8 and 9 and the blade-holder parts 7, consist of materials which are particularly resistant to abrasion. In one possible embodiment of the invention, which is not shown in the attached drawings, the lateral cheeks 27 and 28 of the ring-support 6 can also be protected by wear plates.

Figure 7:
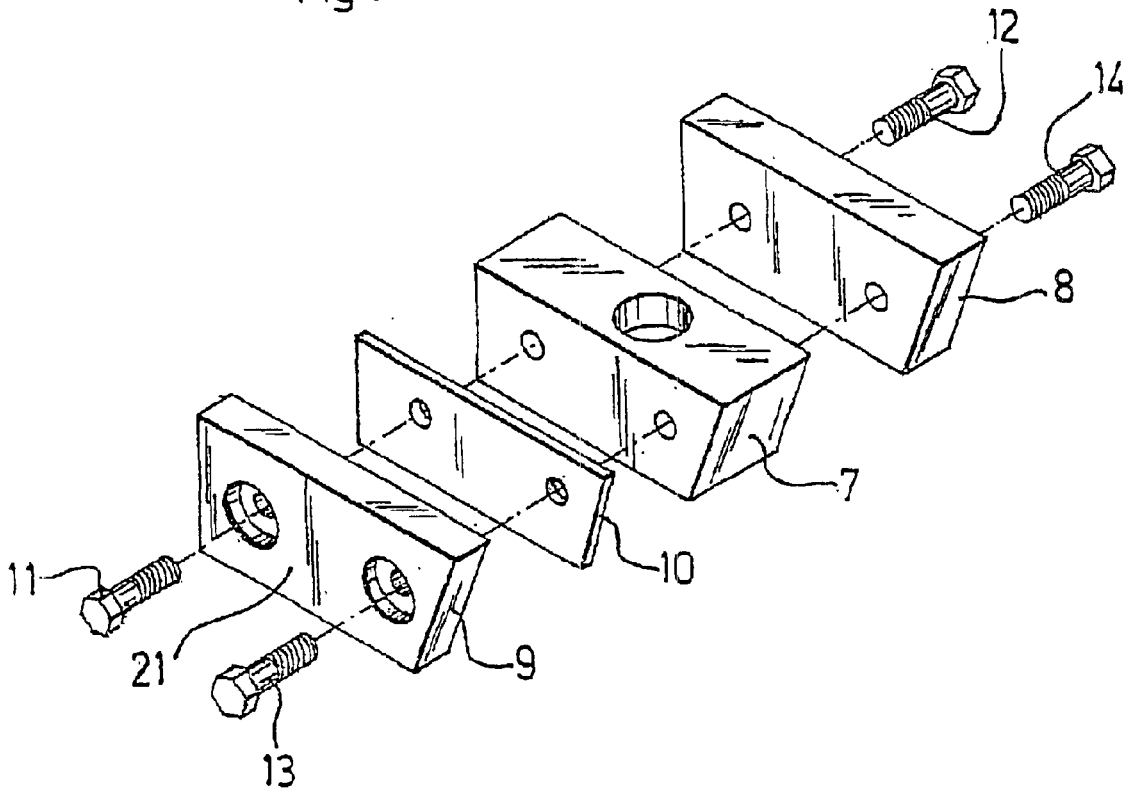
FIG. 7 is a partial exploded perspective view illustrating fitting of the wedges and blades onto a blade-holder part, or removal from the latter.
Figure 8:
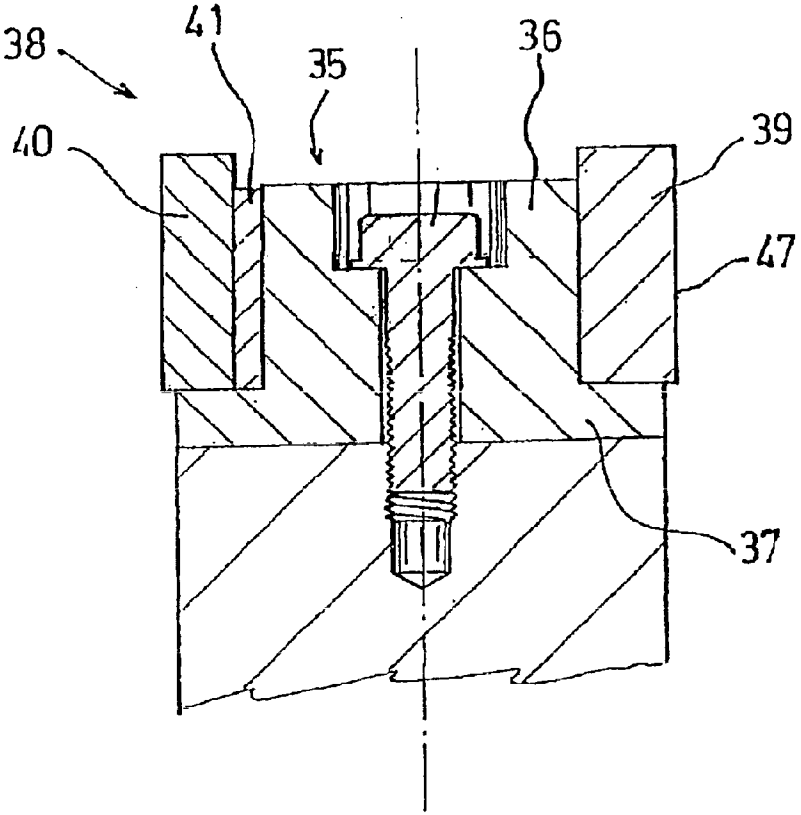

According to another embodiment of the invention illustrated in FIG. 8, the blade-holder part 35 can comprise a head 36 with a reduced axial dimension and a base 37 with an overall axial dimension which is substantially the same as, or slightly smaller than, the axial dimension L of the blade-holder/blade assembly. The blades 39 and 40 and the making-up wedges such as 41 are supported on the base 37. The blade-holder part 35 consists of a material which is more resistant than that of the ring-support 6: the part of the cheeks or lateral surfaces made of this resistant material thus extends to a larger surface in this embodiment than in the example illustrated in FIGS. 1 to 7. This embodiment makes it possible to clear any lateral wear plates. Another advantage of this embodiment is that it guarantees improved securing of the blades on their blade-holder part, since the base of the latter acts as a seat for the blade.

Figure 6:
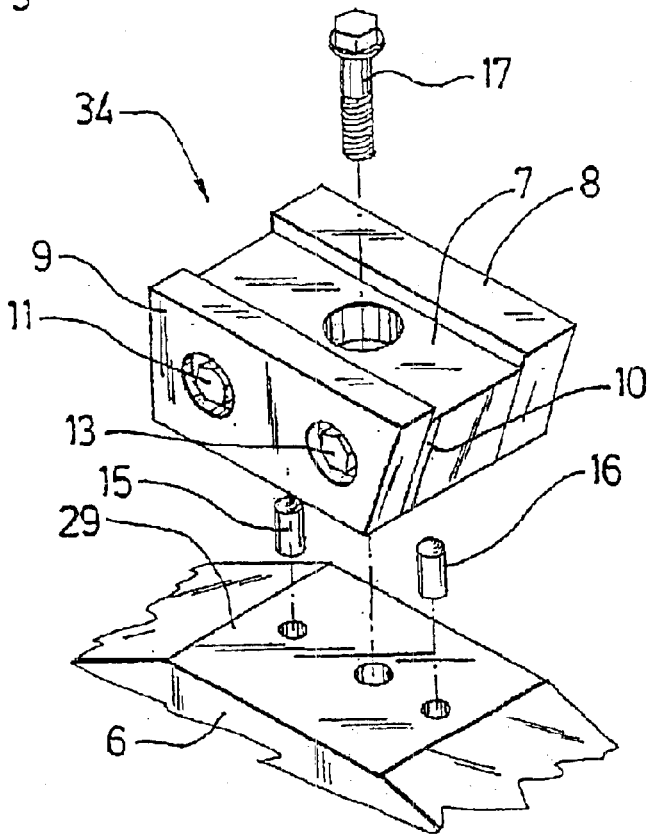
FIG. 6 is a partial exploded perspective view illustrating the fitting of a blade-holder/blade assembly onto the ring-support, or removal from the latter.

The invention also relates to a method for maintenance of a waste grinder which is partially illustrated in FIGS. 6 and 7. With the device according to the invention, the restoration of a worn blade 8 or 9 is a quick and simple operation: the removable blade-holder/blade assembly 34 is detached by unscrewing the screws 17 which connect the blade-holder part 7 to the ring-support 6. In order to prevent prolonged immobilisation of the grinder, a new blade-holder/blade assembly is advantageously put into place and secured to the said ring-support. Its position is adjusted by means of two centring pins 15 and 16 and is firmly retained by the screw 17. The blade(s) 9 (and/or 8) to be restored from the removed assembly is/are then separated from its (or their) blade-holder part 7 by unscrewing the screws 11 and 13 (and/or 12 and 14). A wedge 10 is interposed between the blade-holder part 7 and a blade 9 (or the existing wedge is replaced by a wedge with a larger axial dimension), such that the axial dimension L of the blade-holder/blade assembly 34 constituted is greater than that which is appropriate. The assembly is fitted onto tooling which has a reception surface suitable for the inner surface of the said assembly, which tooling is designed to be secured to a grinding machine for grinding of each of the outer lateral shearing surfaces 18 and 21 of the two blades 8 and 9. The blade-holder/blade assembly 34 thus restored can be stored and used subsequently, as a replacement for another defective assembly.

What is claimed is:

1. A shearing wheel for a waste grinder, comprising:

a cylindrical ring-support (6), which has two lateral cheeks (27,28) and a peripheral surface (29) which define a plurality of sections (30,31), said ring-support being designed to be rotated around an axis by a shaft (3);

a plurality of shearing blades (8,9), each of which has an outer lateral shearing surface (18,21), each blade being disposed corresponding to a section (30) of the peripheral surface (29) of the ring-support (6) to project radially relative to said peripheral surface, wherein said shearing wheel comprises:

a plurality of blade-holder parts (7), each comprising a surface (23), known as the inner surface, with a shape which is designed to be applied to a section (30) of the peripheral surface (29) of the ring-support, a surface (26), known as the outer surface, which is opposite the inner surface, and at least one lateral surface (24) for securing a shearing blade (8);

first means for detachable securing (11–14), which are designed to permit securing of a shearing blade (8,9) onto a blade-holder part (7), and are accessible from the outer lateral shearing surface (18) of the blade, said blade being designed to be secured onto the blade-holder part opposite a lateral securing surface (24, 25) of said part, in order to form a rigid blade-holder/blade assembly (34) together with the blade-holder part; and second means for detachable securing (15–17), which are designed to permit securing of a blade-holder part (7) onto the ring-support (6), and are accessible from the outer surface (26) of said blade-holder part, in order to allow the blade-holder/blade assembly (34) to be secured onto the ring-support, or removed from the ring-support, wherein, each section (30) of the ring-support supports a blade-holder part (7), and each blade-holder part (7) supports at least one blade (8), the blades being arranged around the ring-support (6) so that two adjacent blades are contiguous, the outer lateral shearing surfaces (18) of the blades forming a continuous lateral shearing surface, and each blade-holder part (7) has two lateral surfaces (24,25) for securing a blade, onto each of which a blade (8,9) is secured to form two opposite continuous lateral shearing surfaces on the periphery of the wheel.

2. A shearing wheel as claimed in claim 1, wherein each blade (8) is secured to a blade-holder part (7) such that each blade extends radially at least as far as the outer surface (26) of said blade-holder part.

3. A shearing wheel as claimed in claim 1, wherein each blade (8) has a form and an arrangement which are designed to project radially relative to the outer surface (26) of the blade-holder part (7), at a height which increases from upstream in the downstream direction, relative to the direction of rotation of the wheel, to form a tooth (42) to drive and shear the waste.

4. A shearing wheel as claimed in claim 1, wherein each blade (9) has an edge (20), known as the inner edge, which is designed to be placed axially adjacent the inner surface (23) of the blade-holder part (7) onto which the blade is secured.

5. A shearing wheel as claimed in claim 4, wherein each blade (9) has an inner edge (20) with a form which is designed to be supported at least partly on a section (30) of the peripheral surface (29) of the ring-support (6), each blade-holder part (7) having an axial dimension which is smaller than the axial dimension of the ring-support.

6. A shearing wheel as claimed in claim 1, wherein each blade-holder part (35) has a base (37) and a head (36) with an axial dimension which is smaller than an axial dimension of the base, such that:

the head has at least one lateral surface (43) for securing a blade, opposite which a blade (39) is secured; and the base has at least one outer surface (45) against which the blade (39) is supported.

7. A shearing wheel as claimed in claim 1, wherein the ring-support has a peripheral surface with a cylindrical shape which revolves around the axis of rotation, the blade-holder parts having inner surfaces with a cylindrical shape which is designed to be applied to a section of said peripheral surface of the ring-support.

8. A shearing wheel as claimed in claim 1, wherein the ring-support (6) has a polygonal peripheral surface (29) which defines flat sections (30,31), each blade-holder part (7) having a flat inner surface (23) which is designed to be applied to a section (30,31) of the peripheral surface of said ring-support.

9. A rotor for a waste grinder, comprising at least one shearing wheel as claimed in claim 1, which is integral with a shaft (3) which rotates said wheel around an axis.

10. A waste grinder, comprising at least two rotors (1,2) as claimed in claim 9 with parallel axes, the wheels of said rotors being arranged on their respective shaft (3,4) to interpenetrate and to have adjacent lateral shearing surfaces which are separated by shearing play.

11. A method for maintenance of a waste grinder as claimed in claim 10, for the purpose of replacement or restoration of at least one blade (9), wherein:

the blade-holder/blade assembly (34) concerned is separated from the ring-support (6), by maneuvering the second means for securing (17) which connect the blade-holder part (7) to the ring-support; and a new blade-holder/blade assembly is put into place and secured to the peripheral surface (29) of the ring-support, by manoeuvring the second means for securing (15–17) which connect the blade-holder part (7) to the ring-support (6).

12. A method for maintenance as claimed in claim 11, wherein:

the blade-holder/blade assembly (34) concerned having been detached and separated from the wheel, the blade (s) (9) is/are separated from the blade-holder part (7) by manoeuvring the first means for securing (11) which connect the blade to said part;

said blade is replaced by a new blade, and the new blade is secured to the blade-holder part (7) by manoeuvring the first means for securing (11) which connect the blade to said part; and the new blade-holder/blade assembly obtained is put into place and secured to the ring-support (6).

13. A method for restoration of a blade-holder/blade assembly of a waste grinder as claimed in claim 10, wherein:

the blade-holder/blade assembly (34) concerned having been detached and separated from the wheel, the blade (9) is separated from the blade-holder part (7) by manoeuvring the first means for securing (11) which connect the blade to said part;

a squared part, known as a wedge (10) is put into place against an outer lateral surface (25) of the blade-holder part;

the blade (9) concerned is positioned against said wedge, and the wedge/blade assembly is secured to the blade-holder part, by manoeuvring the first means for securing (11) which connect the blade to the said part; and the outer lateral shearing surface(s) (21) of the blade(s) (9) is/are ground to adjust the axial dimension L of the blade-holder/blade assembly (34) and the position of said outer lateral shearing surface (21) relative to the blade-holder part (7).

14. A method for maintenance of a waste grinder as claimed in claim 11, wherein:

the blade-holder/blade assembly (34) concerned is restored; and the new blade-holder/wedge/blade assembly obtained is put into place and secured to the ring-support (6).

15. A method for dismantling a rotor of a waste grinder as claimed in claim 10, wherein:

at least one row of axially aligned blade-holder/blade assemblies (34) is removed by manoeuvring the second means for securing (15–17) which connect each blade-holder part concerned to a corresponding ring-support;

the rotor is rotated around the rotor's axis, such that the row of sections (30) of peripheral surfaces without blade-holder/blade assemblies is situated on the plane which contains the axes of rotation of the two rotors; and the rotor is slid axially until withdrawn from the grinder.

16. A method for maintenance of a waste grinder as claimed in claim 10, for the purpose of replacement or restoration of at least one blade (9), wherein:

the blade-holder/blade assembly (34) concerned is separated from the ring-support (6), by maneuvering the second means for securing (17) which connect the blade-holder part (7) to the ring-support;

a new or previously restored blade-holder/blade assembly is put into place and secured on the peripheral surface (29) of the ring-support (6), by maneuvering the second means for securing (15–17) which connect the blade-holder part (7) to the ring-support;

the worn blade-holder/blade assembly (34) removed is restored according to a method for restoration wherein the blade (9) is separated from the blade-holder part (7) by maneuvering the first means for securing (11) which connect the blade to said part; a squared part, known as a wedge (10), is put into place against the outer lateral surface (25) of the blade-holder part; the blade (9) concerned is positioned against said wedge, and the wedge/blade assembly is secured to the blade-holder part, by maneuvering the first means for securing (11) which connect the blade to said part; and the outer lateral shearing surface(s) (21) of the blade(s) (9) is/are ground to adjust the axial dimension L of the blade-holder/blade assembly (34) and the position of said outer lateral shearing surface (21) relative to the blade-holder part (7); and the blade-holder/wedge/blade assembly thus obtained is stored for use in a subsequent maintenance operation.

17. A rotor for a waste grinder comprising:

a shaft (3);

a shearing wheel, comprising a cylindrical ring-support (6), which has two lateral cheeks (27,28) and a peripheral surface (29) which define a plurality of sections (30,31), said ring-support being designed to be rotated around an axis by the shaft (3);

a plurality of shearing blades (8,9), each of which has an outer lateral shearing surface (18,21), each blade being disposed corresponding to a section (30) of the peripheral surface (29) of the ring-support (6), to project radially relative to said peripheral surface, said shearing wheel comprising a plurality of blade-holder parts (7), each comprising a surface (23), known as the inner surface, with a shape which is designed to be applied to a section (30) of the peripheral surface (29) of the ring-support, a surface (26), known as the outer surface, which is opposite the inner surface, and at least one lateral surface (24) for securing a shearing blade (8);

first means for detachable securing (11–14), which are designed to permit securing of a shearing blade (8,9) onto a blade-holder part (7), and are accessible from the outer lateral shearing surface (18) of the blade, said blade being designed to be secured onto the blade-holder part opposite a lateral securing surface (24,25) of said part, in order to form a rigid blade-holder/blade assembly (34) together with the blade-holder part; and second means for detachable securing (15–17), which are designed to permit securing of a blade-holder part (7)

onto the ring-support (6), and are accessible from the outer surface (26) of said blade-holder part, in order to allow the blade-holder/blade assembly (34) to be secured onto the ring-support, or removed from the ring-support;

the shearing wheel being integral with the shaft (3) which rotates said wheel; and plurality of identical wheels which are spaced regularly along the drive shaft (3), each blade-holder part (7) of each of said wheels having two lateral securing surfaces (24,25) onto each of which a blade (8,9) is secured-r to form around said wheel two continuous opposite lateral shearing surfaces.

18. A shearing wheel for a waste grinder, comprising:

a cylindrical ring-support (6) with two lateral cheeks (27,28) and a peripheral surface (29) defining a plurality of sections (30,31), said ring-support being rotatable around an axis;

a plurality of shearing blades (8,9), each blade having an outer lateral shearing surface (18,21), each blade being disposed corresponding to a section (30) of the peripheral surface (29) of the ring-support (6) to project radially relative to the peripheral surface, wherein said shearing wheel comprises a plurality of blade-holder parts (7), each blade-holder part comprising i) an inner surface (23) with a shape to be applied to a section (30) of the peripheral surface (29) of the ring-support, ii) an outer surface (26), opposite the inner surface, and iii) at least one lateral surface (24) for securing a shearing blade (8);

a first securing means (11–14) to permit detachable securing of the shearing blade (8,9) onto the blade-holder part (7), the blade to be secured onto the blade-holder part opposite a lateral securing surface (24,25) of the blade-holder part, in order to form a rigid blade-holder/blade assembly (34) together with the blade-holder part, the first securing means being accessible from the outer lateral shearing surface (18) of the blade; and a second securing means (15–17) to permit detachable securing of the blade-holder part (7) onto the ring-support (6) in order to allow the blade-holder/blade assembly (34) to be secured onto the ring-support, or removed from the ring-support, the second securing means being accessible from the outer surface (26) of said blade-holder part, wherein, each section (30) of the ring-support supports a blade-holder part (7), and each blade-holder part (7) supports at least one blade (8), the blades being arranged around the ring-support (6) so that two adjacent blades are contiguous, the outer lateral shearing surfaces (18) of the blades forming a continuous lateral shearing surface, and each blade-holder part (7) has two lateral surfaces (24,25) for securing a blade, onto each of which a blade (8,9) is secured to form two opposite continuous lateral shearing surfaces on the periphery of the wheel.

* * * * *

UNITED STATES PATENT AND TRADEMARK OFFICE

CERTIFICATE OF CORRECTION

PATENT NO. : 6,854,676 B2
DATED : February 15, 2005
INVENTOR(S) : Dubech et al.

It is certified that error appears in the above-identified patent and that said Letters Patent is hereby corrected as shown below:

Title page,
Item [86], PCT No., change the § 371 date from "Nov. 15, 2002" to -- Nov. 19, 2002 --.

Signed and Sealed this

Fifth Day of July, 2005

JON W. DUDAS
*Director of the United States Patent and Trademark Office*